US005491950A

United States Patent [19]

Obegi

[11] Patent Number: 5,491,950

[45] Date of Patent: Feb. 20, 1996

[54] MODULAR SHEAR PANEL SYSTEM

[76] Inventor: Joseph Obegi, 1041 Hatteras Ct., Foster City, Calif. 94404

[21] Appl. No.: 326,014

[22] Filed: Oct. 18, 1994

[51] Int. Cl.[6] ..... E04C 3/02

[52] U.S. Cl. ..... 52/693; 52/695; 446/107; 446/118; 446/126; 47/70; 256/25

[58] Field of Search ..... 52/693, 695; 446/118, 446/126, 105, 107; 47/70; 256/36, 25, 24

[56] References Cited

U.S. PATENT DOCUMENTS

| | | | |
|---|---|---|---|
| 317,939 | 5/1885 | Halfpenny | 47/70 X |
| 1,092,591 | 4/1914 | Pajeau . | |
| 1,113,371 | 10/1914 | Pajeau . | |
| 3,176,428 | 7/1961 | Slingluff | 46/17 |
| 3,600,825 | 8/1971 | Pearce | 35/18 A |
| 4,271,628 | 6/1981 | Barlow | 46/29 |
| 4,302,900 | 12/1981 | Rayner | 46/29 |
| 4,326,354 | 4/1982 | Hogberg | 446/126 |
| 4,701,131 | 10/1987 | Hildebrandt et al. | 434/211 |
| 4,708,684 | 11/1987 | Chen | 446/127 |
| 4,787,191 | 11/1988 | Shima | 52/648 |
| 5,049,105 | 9/1991 | Glickman | 446/126 |
| 5,238,438 | 8/1993 | Glickman | 446/126 |
| 5,282,767 | 2/1994 | Gelardi | 446/126 |
| 5,318,470 | 6/1994 | Denny | 446/126 |

FOREIGN PATENT DOCUMENTS

| | | | |
|---|---|---|---|
| 2672784 | 8/1992 | France | 47/70 |
| 2058590 | 9/1979 | United Kingdom | 446/126 |
| 2108857 | 11/1981 | United Kingdom | 446/126 |

OTHER PUBLICATIONS

Charley's Greenhouse Supply advertisement, Sunset Magazine, Oct. 1994, p. 150.

Applicant's Invention Disclosure Document, 362044, received by PTO on Sep. 21, 1994.

*Primary Examiner*—Carl D. Friedman
*Assistant Examiner*—W. Glenn Edwards
*Attorney, Agent, or Firm*—Ray K. Shahani

[57] ABSTRACT

The present invention relates generally to construction and building toys, blocks and the like for children and structurally similar construction and building materials and components for building retaining walls, support structures and lattices, trellises, and enclosed structures and other self supported units comprised of a plurality of individual, modular, high-shear panels, and more particularly, to a plurality of cross members having discrete and individual openings at various and specific locations within the cross members and a plurality of tubular or cylindrical or other cross-sectional shaped lateral members, the lateral members being set into the openings within the cross members such that, upon assembly, modular, high shear strength panels are created.

19 Claims, 4 Drawing Sheets

MODULAR SHEAR PANEL SYSTEM

DISCLOSURE DOCUMENT

This invention was initially described and disclosed to the U.S. Patent and Trademark Office in Disclosure Document No. 362044, received Sep. 21, 1994, which is hereby expressly incorporated herein by reference.

FIELD OF THE INVENTION

The present invention relates generally to construction and building toys, blocks and the like for children and structurally similar construction and building materials and components for building retaining walls, support structures and lattices, trellises, and enclosed structures and other self supported units comprised of a plurality of individual, modular, high-shear panels, and more particularly, to a plurality of cross members having discrete and individual openings at various and specific locations within the cross members and a plurality of tubular or cylindrical or other cross-sectional shaped lateral members, the lateral members being set into the openings within the cross members such that, upon assembly, modular, high shear strength panels are created.

BACKGROUND OF THE INVENTION

U.S. Pat. No. 1,092,591 issued Apr. 7, 1914 to Pajeau teaches mechanical construction blocks. U.S. Pat. No. 1,113, 371 issued Apr. 7, 1914 to Pajeau teaches mechanical construction blocks. These patents teach the children's toys known as "Tinker Toys" and are essentially sets of rods with tapered or slit ends, round pieces with holes for inserting the rods, blocks with holes and grooves for attaching together and to the rods, and the systems are useful and entertaining for children and other modeling functions for building objects or structures and being fully disassembleable.

U.S. Pat. No. 3,176,428 issued Apr. 6, 1965 to Slingluff teaches games and toys embodying rods and coupling means of various characters or connecting the rods together at different angles to fabricate buildings, bridges, etc. Resilient and deformable straws are employed.

U.S. Pat. No. 3,600,825 issued Aug. 24, 1971 to Pearce teaches synthesized natural geometric structures. The invention is an assembly, kit or set of component parts for assembling erecting or construction of geometric figures to be used for purposes o science and research, modeling, and architecture, and consists of a universal node having spokes extending therefrom and allows for aa plurality of nodes to be interconnected with specific geometric patterns being created thereby.

U.S. Pat. No. 4,271,628 issued Jun. 9, 1981 to Barlow teaches a geometric construction toy apparatus. This is a toy apparatus for the formation of 2 and 3 dimensional geometric structures and includes a plurality of substantially spherical connector members each having a plurality of radial sockets or prongs arranged around a central point in the connector member, a plurality of slender connecting members in groups of different lengths and forming tetrahedrons, octahedrons and cubic structures.

U.S. Pat. No. 4,302,900 issued Dec. 1, 1981 to Rayner teaches nodal elements with channels for push fitted rods. This construction toy has a plurality of nodal elements and a plurality of co-operation rod elements with each nodal element being spherical and having channels formed on the peripheral surfaces. The rod elements have a connecting portion at each end with a grooved cross sectional end shape which can be push fitted into the co-operating channels off the nodal elements.

U.S. Pat. No. 4,701,131 issued Oct. 20, 1987 to Hildebrandt teaches a geometric modeling kit and method of making same the system is made up of a plurality of nodes and shape coded connectors extending therebetween, the nodes having a plurality of outer polygonal elements. The elongated connectors have precisely shaped ends which are inserted into the polygonally shaped openings in the outer surfaces of the nodes.

U.S. Pat. No. 4,708,684 issued Nov. 24, 1987 to Chen teaches a toy building block set. This invention has several blocks including a circular member on the outer circumference of which a plurality of connecting elements and sockets are provided whereby the block sets are capable of being developed into a variety of articles, and assembling with an inflatable member to enable the finished work to float on the surface of water.

U.S. Pat. No. 5,049,105 issued Sep. 17, 1991 to Glickman teaches a hub connector for tubes in toy construction set. This invention includes a central hub portion with a series of radially extending, split lugs. The tube members are inserted over the split lugs, thereby compressing the lugs and securing the tubes in place U.S. Pat. No. 5,049,105 issued Aug. 11, 1992 to Glickman teaches multi planar connector element for construction toy. U.S. Pat. No. 5,238,438 issued Aug. 24, 1993 to Glickman teaches a construction toy and adapter. These two patents teach construction toys which have hub like central connectors and elongated members. The hub portions have end portions specially configured to be received into gripping sockets made of pairs of gripping arms formed of deflectable plastic material. Concave grooves adapted for lateral, snap-in assembly of structural elements allow various shapes and formations to be built.

U.S. Pat. No. 5,282,7677 issued Feb. 1, 1994 to Gelardi teaches construction sets with injection molded and extruded tube beams. Straght and curved tube beams have joint ends with flanges which control the depth of penetration of the beams into cylindrical receivers within cubic connectors.

U.S. Pat. No. 5,318,470 issued Jun. 7, 1994 to Denny teaches a modular construction assembly. The assembly consists of connecting hubs made of semi-spherical lobes and a central ring each having rounded protrusions, adapted to engage or receive the hollow ends of tubular members.

Other products currently available on the market include kits for constructing buildings and small greenhouses, etc. out of aluminum framing, etc. However, these products are for permanent constructions, require extensive assembly, or must be purchased preassembled. Furthermore, it is difficult to find modular units which can be used for flower trellises or structures to train flowers or other shrubbery onto.

Thus it would be desirable to provide simple, lightweight weight but high strength panels which could be used separately or in conjunction with others to create children's toys, construction blocks, geometric or molecular or architectural modeling tools, flower trellises, wall covering panels, or free standing, multidimensional structures such as greenhouses, spa covers, and the like.

SUMMARY OF THE INVENTION

This new invention provides a wonderful new toy for children, teaching them how to build geometric shapes and structures and allowing them to be creative and to develop manual dexterity. Additionally, the devices can be larger and used to construct elegant trellises and gates, fencing, covered walkways, and outdoor/indoor structures. This can be a "construct it yourself" product or can be purchased ready assembled. It offers unlimited shapes and designs for personalized uses and landscaping touches. Outdoor trellises, gazebos, greenhouses, fences, gates, kids toys and puzzles are but a few of the many uses.

A modular shear panel system for use as children's toys, construction blocks, modeling systems, geometric structures and landscaping accessories including ornamental plant supports, multi dimensional and self supporting structures, said modular shear panel system is hereby disclosed. It essentially comprises a plurality of hollow cross members, each of the cross members having a predetermined length and a plurality of ends. Each of the cross members has an external surface divided into a plurality of external faces, each of the hollow cross members have an internal chamber defined by an interior surface, each of the cross members have a predetermined cross section size and shape, and each of the cross members have a plurality of openings located on the plurality of external faces extending between the external surface and the internal chamber. Each of said plurality of openings having a predetermined size and shape and each of the openings having a plurality of corresponding regions of the external face adjacent to the openings The invention also comprises a plurality of lateral members, each of the lateral members having an elongated shape and a predetermined length, each of the lateral members having a plurality of ends, and each of the lateral members having a cross section size and shape essentially similar to the size and shape of the plurality of openings. Each of the ends of the plurality of lateral members are to be disposed within the plurality of openings located on the plurality of cross members such that the ends of the lateral members bear against the internal surface of the plurality of hollow cross members thereby maintaining the plurality of lateral members and the plurality of cross members in a fixed orientation.

In the invention, the ends of the plurality of lateral members are disposed within the plurality of the openings located on the plurality of cross members such that a stress is produced within the plurality of corresponding regions of the external face adjacent to the openings thereby maintaining the plurality of lateral members and the plurality of cross members in the fixed orientation.

In the invention the location of the plurality of openings on the external faces of the cross members are predetermined according to a specific configuration shear panel. Alternatively, in the invention the location of the plurality of openings on the external faces of the cross members are spaced sequentially along the external faces allowing a multiplicity of different configuration shear panels. Alternatively, in the invention there is the greatest number of openings on the external faces as possible while maintaining the plurality of lateral members and the plurality of cross members in the fixed orientation allowing a multiplicity of different configuration shear panels. Furthermore, the invention might only have two cross members.

The invention further comprises a connector, the connector connecting a plurality of modular shear panels of the present invention to each other to provide a structure with a predetermined configuration. The connector connects the ends of the plurality of cross members by having portions with a size and shape essentially similar to the cross section size and shape of the plurality of cross members such that the connector can be installed within the hollow chamber of the plurality of cross members at the ends. The connector connects a plurality of modular shear panels such that the plurality of modular shear panels are fixed in an essentially co-planar arrangement, or in a non co-planar arrangement, or in an arrangement such that the plurality of modular shear panels form a free-standing structure.

The predetermined cross section shape of the cross members is circular or rectangular or square, or any other operative shape. The cross section shape of the lateral members is circular or rectangular or square, or any other operative shape.

The invention further comprises additional plurality of cross members and additional plurality of lateral members such that a covered structure is thereby configured.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE INVENTION

Figure 1:
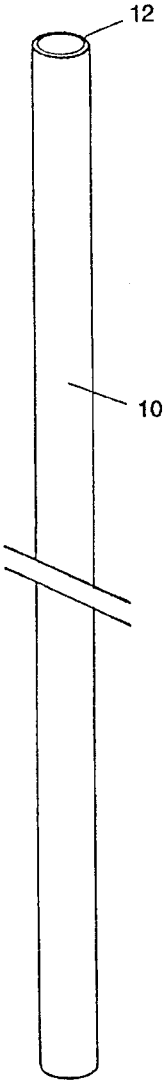
FIG. 1 is a perspective view of a tubular lateral member of the present invention.

FIG. 1 is a perspective view of a tubular lateral member of the present invention. The lateral member 10 can be short or long, depending upon the application. The cross sectional shape shown at end 12 can be circular, as shown, or can be square, rectangular, or other shape. It could also have a flat, angle or tee shaped cross section. The lateral member could be solid or hollow, depending upon the weight, strength or material of construction. These different materials would include wood, plastic, PVC, other polymeric material, metals including aluminum, titanium, steel or iron, or other useful material depending upon the application. The overall lengths and other dimensions of the lateral members can vary, depending upon the applications involved. It will be understood that a range of dimensions are possible, including lengths as short as a few inches (children's toys, modeling tools, etc.) or as long as several meters (wall covering structure, arbors or walk-in structures).

Figure 2A:
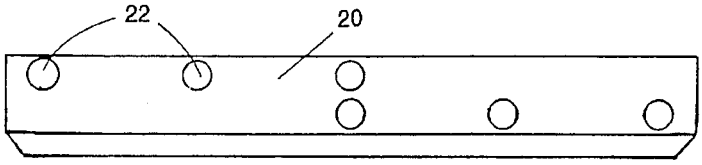
FIGS. 2A–2D are perspective view of various preferred embodiments of the tubular cross members of the present invention.
Figure 2B:
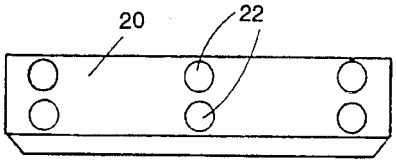
Figure 2C:
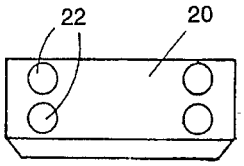
Figure 2D:
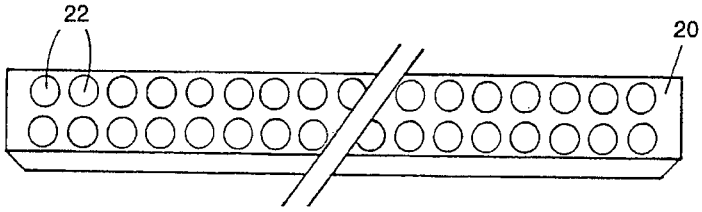

FIGS. 2A–2D are perspective view of various preferred embodiments of the tubular cross members of the present invention. The cross members 20 can be different lengths and sizes. Small sections might be useful with a specific number openings 22 as shown in FIGS. 2A–2B. Alternatively, there can be large number of openings, as shown in FIG. 2D. It is important to note that there is a wide variety of embodiments possible, depending upon the application intended. For example, the cross member of FIG. 2A could be used when a specific configuration for a panel is contemplated and uses each and every opening in the cross member. Alternatively, cross members with a large number of openings could be made available in kits or systems which allow flexibility and diversity of design, and the openings actually used can be selected by the user at the time of assembly of the panel module.

The cross section shape of the hollow cross members can be any shape which provides adequate support for the lateral members once inserted in to the holes. Square or rectangular cross members are shown, as these provide extremely high shear strength once in an assembly, and are commonly available. Other shapes include round, etc.

Figure 3B:
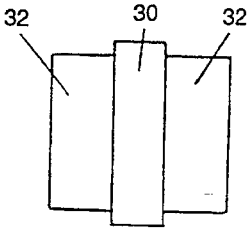
FIGS. 3A–3B and 4A–4D are cross section and perspective views of various connectors for panel modules of the present invention.
Figure 3A:
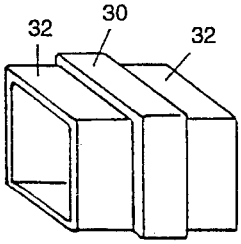

FIGS. 3A–3B and 4A–4D are cross section and perspective views of various connectors for panel modules of the present invention. FIGS. 3A and 3B show a straight connector for use with a square or rectangular shaped cross member. A central portion 30 would have a cross section which would be typically about the same dimensions as that of the cross members. Outer portions 32 would be somewhat smaller. As contemplated, these connectors would be inserted into the ends of the cross members and allow multiple panel modules to be linked together to create a fence or other type of extended structure.

Figure 4D:
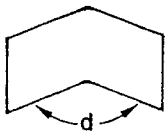
Figure 4C:
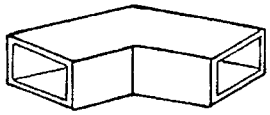
Figure 4B:
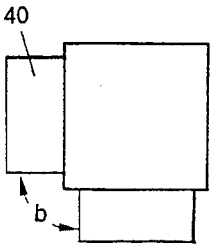
Figure 4A:
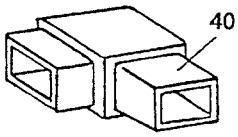

FIGS. 4A and 4B show a connector with a roughly 90 degree angle b. It will be understood that the reduced dimension portions 40 will be inserted into the ends of cross members on individual panel modules and multiple panels can form a free standing or multidimensional structure. FIGS. 4C and 4D show a connector with an angle d. It will be understood that this angle can be varied almost infinitely between 180 degrees as shown in FIGS. 3A and 3B, to 90 degrees as shown in FIGS. 4A and 4B, to almost any operable angle smaller than 90 degrees. Thus, a structure such as a spa cover or gazebo can be assembled using a plurality of individual panel modules along with several connectors, each the same angle or different or any combination. Square, rectangular, five, six, seven or eight or more sides can be assembled using appropriate angle connectors.

Figure 5A:
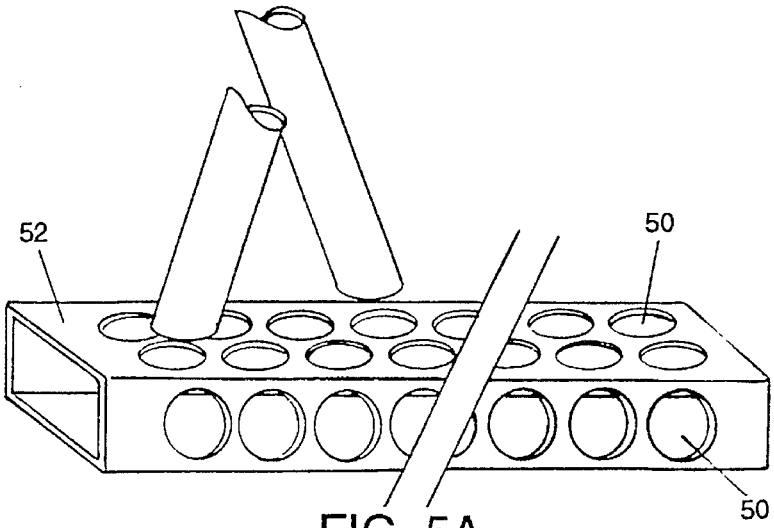
FIGS. 5A and 5B are perspective view of various embodiments of the cross members of the present invention.
Figure 5B:
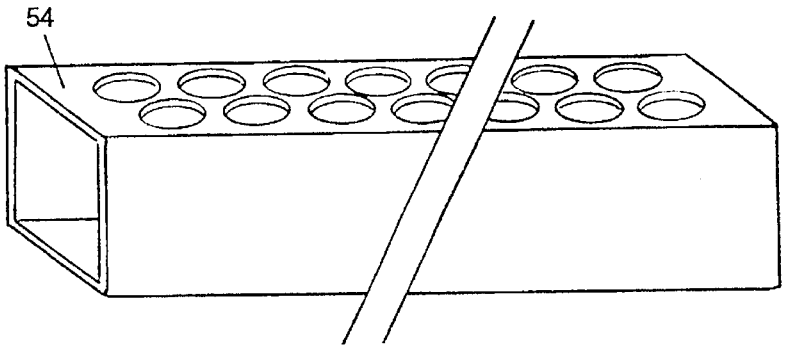

FIGS. 5A and 5B are perspective view of various embodiments of the cross members of the present invention. The purpose of this figure is to demonstrate the wide variety of embodiments possible. FIG. 5A shows a rectangular tubing cross member having openings 50 on more than one side. There could be openings on one to four sides of a four sided tube. Similarly, if the tubing was triangular or had more than 4 sides, there could be openings on any or all of the sides. FIG. 5B shows how the rows of openings need not be spaced directly across from each other, as in the top face 52 of FIG. 5A, but can instead be offset from each other, as shown on the top face 54 of the cross member shown in FIG. 5B. The distinction between the two embodiments is that, depending upon the design and intended use of the panel module, different structures can be assembled having different aesthetic and structural characteristics.

Figure 6:
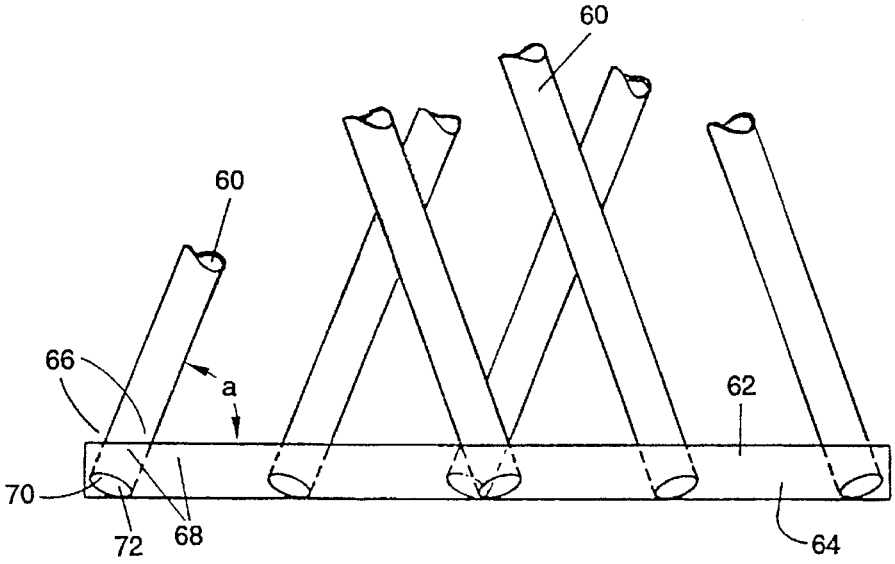
FIG. 6 is a partial cross section view of lateral members disposed within the openings of a cross member of the present invention.
Figure 7:
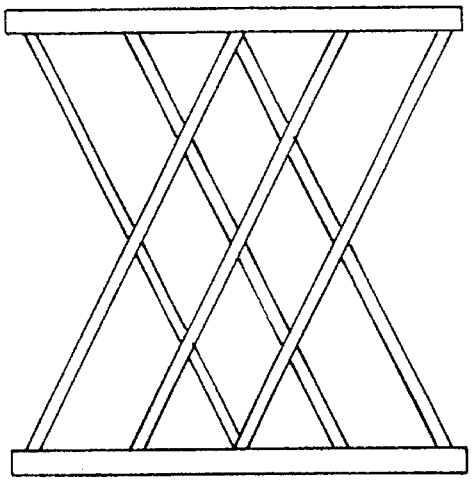
FIGS. 7–12 are various embodiments of modular panels possible using the present invention.
Figure 8:
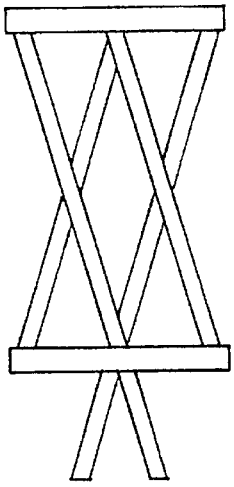
Figure 9:
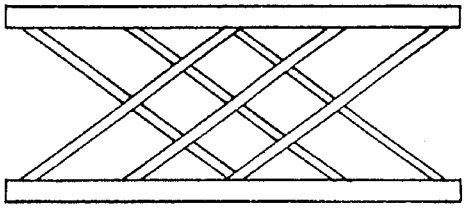
Figure 10:
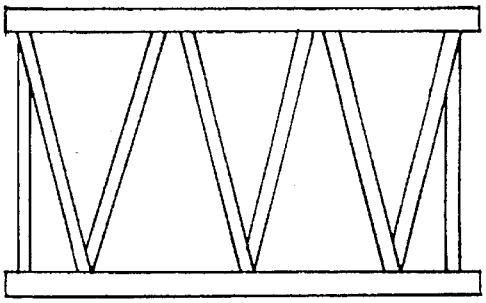
Figure 11:
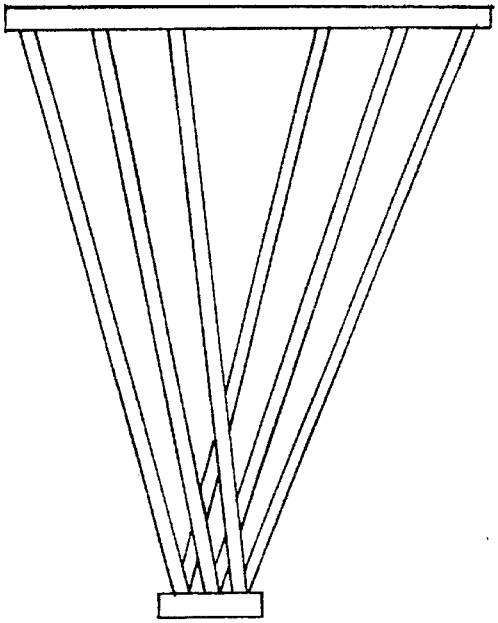
Figure 12:
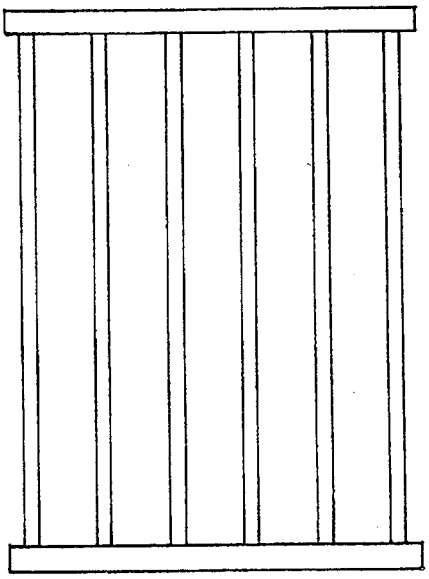

FIG. 6 is a partial cross section view of lateral members disposed within the openings of a cross member of the present invention. The openings shown in the embodiments of this invention are intended to match the shape of the lateral members used. If the lateral members re circular tubing, it is presumed that circular holes, or close to circular holes can be created in the cross members. The cross members are generally hollow and therefore the openings are essentially made perpendicular to the length of the cross member. It is understood that if the cross members are solid, then the openings in the cross members must be drilled or formed at an angle allowing the desired ornamental shape and design to be built. Alternatively, if the lateral members are somewhat elastic or deformable, then they can be inserted into the holes and bent to one side or another to give the desired geometric appearance.

One preferred embodiment is shown in FIG. 6. In this figure, it will be understood that the lateral members 60 are inserted into the openings in the top face 62 of the cross member 64. The angle a at which the lateral member is positioned at is very important. As the angle is increased there will be a greater internal stress created at points 66 on the lateral member and at points 68 on the cross member. A torque effect will introduce an internal strain into the assembly. Additionally, the end 70 of the lateral member would be resting against the inside of the cross member at a point 72. Therefore, the combination of stress at points on the outer portion of the lateral member in contact with the opening in the cross member, and the support provided by the inside surface of the cross member at the point where the end of the lateral member is in contact creates a very high strength panel module once an opposing cross member is installed onto the opposite ends of the lateral members. The ends of the lateral members are shown being perpendicular to the central axis of the lateral member. However, this end cut also could be cut with an angle which would correspond with the angle at which the lateral member is set into the cross member. The internal stresses create a rigid, durable, and modular unit which can be placed at strategic locations as desired for use as a support or structural element. The panels exhibit unprecedented and unexpected shear strength and are useful in a variety of applications.

FIGS. 7–12 are various embodiments of modular panels possible using the present invention. It will be immediately understood that an infinite number of variations are possible. These modular panels can have fewer or greater number of lateral members, depending upon the application. For example, a very dense packing of cross members between two cross members can provide a visual barrier for fences, dividers, or other structures. Similarly, a very few number off lateral members can be employed, just enough to give the panel sufficient shear strength, for uses such as flower trellises, wall structures for gazebos or greenhouses which will be covered with shrubbery or foliage or material such as a tent or tarp or other cloth. It will be understood that the embodiment shown in FIG. 12 would typically provide a less strong shear panel due to the lack of internal strain created at the openings. However, depending upon the shape of the openings in the cross members and the shape of the lateral member, there need only be sufficient internal strain as is necessary to keep the assembly intact and integrated.

Figure 13:
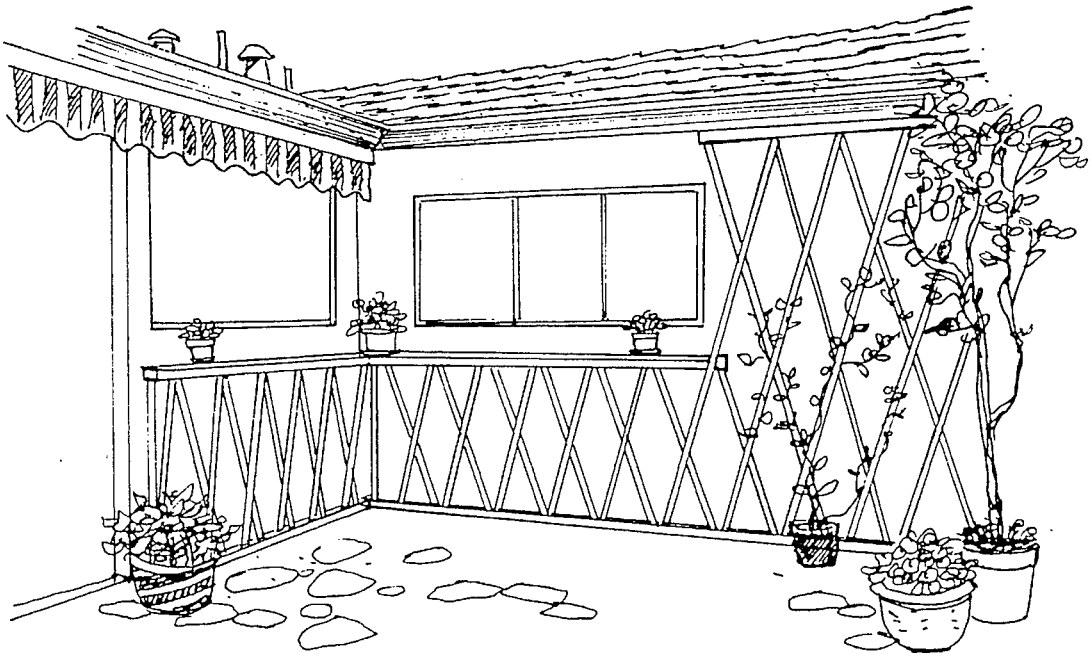
FIG. 13 perspective view of the present invention as it might be used in a typical application.

FIG. 13 is a perspective view of the present invention as it might be used in a typical application. It will be apparent that different shaped, sized, colored, textured, etc. lateral and cross members can be used to create different shaped and function panel modules. A wide variety of possibilities for the use of these panels will be obvious to one skilled in the art, and include landscaping, patio furniture, wall coverings, rood dividers, etc.

Figure 14:
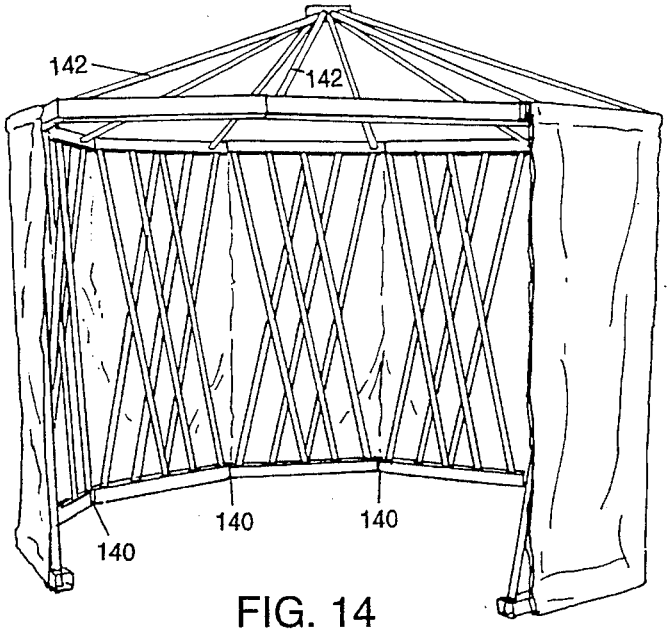
FIG. 14 is a perspective view of another embodiment of the present invention showing specifically a self supporting structure made by connecting a plurality of panel modules together.

FIG. 14 is a perspective view of another embodiment of the present invention showing specifically a self supporting structure made by connecting a plurality of panel modules together. As discussed earlier, the connectors would be placed between the panel modules at points 140. Roof elements 142 can be installed and a self supporting structure can be assembled. Cloth or tarp material can be used to cover the structure. Similarly, if a greenhouse of gazebo or spa cover is so desired, insulating material or glass can be installed onto the panels to keep the structure warm or otherwise environmentally controlled with respect to lighting, air circulation, etc.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

We claim:

1. A modular shear panel system for use as children's toys, construction blocks, modeling systems, geometric structures and landscaping accessories including ornamental plant supports, multi dimensional and self supporting structures, said modular shear panel system comprising:

a plurality of hollow cross members, each of said cross members having a predetermined length and a plurality of ends, each of said cross members having an external surface divided into a plurality of external faces, each of said hollow cross members having an internal chamber defined by an interior surface, each of said cross members having a predetermined cross section size and shape, each of said cross members having a plurality of openings located on said plurality of external faces extending between said external surface and said internal chamber, each of said plurality of openings having a predetermined size and shape, each of said openings corresponding with a particular region of said hollow cross members immediately adjacent to said openings; and a plurality of lateral members, each of said lateral members having an elongated shape and a predetermined length, each of said lateral members having a plurality of ends, each of said lateral members having a cross section size and shape essentially similar to said size and shape of said plurality of openings, each of said ends of said plurality of lateral members being disposed within said plurality of openings located on said plurality of cross members such that said ends of said lateral members bear against the internal surface of said plurality of hollow cross members and produce a stress within said particular regions of said hollow cross members immediately adjacent to said openings in said hollow cross members, said stress produced within said hollow cross members sufficient to bias the plurality of lateral members in certain oblique, opposing directions such that an internal tension is created within the modular shear panel system thereby maintaining said plurality of lateral members and said plurality of cross members in a fixed orientation.

2. The invention of claim 1 wherein the location of said plurality of openings on said external faces of said cross members are predetermined according to a specific configuration shear panel.

3. The invention of claim 1 wherein the location of said plurality of openings on said external faces of said cross members are spaced sequentially along the external faces allowing a multiplicity of different configuration shear panels.

4. The invention of claim 1 wherein there is the greatest number of openings on said external faces as possible while maintaining said plurality of lateral members and said plurality of cross members in said fixed orientation allowing a multiplicity of different configuration shear panels.

5. The invention of claim 1 having two cross members.

6. The invention of claim 1 further comprising a connector, said connector connecting a plurality of modular shear panels of the present invention to each other to provide a structure with a predetermined configuration.

7. The invention of claim 6 wherein said connector connects said ends of said plurality of cross members by having portions with a size and shape essentially similar to said cross section size and shape of said plurality of cross members such that said connector can be installed within said hollow chamber of said plurality of cross members at said ends.

8. The invention of claim 1 wherein said predetermined cross section shape of said cross members is circular.

9. The invention of claim 1 wherein said predetermined cross section shape of said cross members is rectangular.

10. The invention of claim 1 wherein said predetermined cross section shape of said cross members is square.

11. The invention of claim 1 wherein said predetermined cross section shape of said cross members is any other operative shape.

12. The invention of claim 1 wherein said cross section shape of said lateral members is circular.

13. The invention of claim 1 wherein said cross section shape of said lateral members is square.

14. The invention of claim 1 wherein said cross section shape of said lateral members is rectangular.

15. The invention of claim 1 wherein said cross section shape of said lateral members is any other operative shape.

16. The invention of claim 6 wherein said connector connects a plurality of modular shear panels such that said plurality of modular shear panels are fixed in an essentially co-planar arrangement.

17. The invention of claim 6 wherein said connector connects a plurality of modular shear panels such that said plurality of modular shear panels are fixed in a non co-planar arrangement.

18. The invention of claim 6 wherein said connector connects a plurality of modular shear panels such that said plurality of modular shear panels form a free-standing structure.

19. The invention of claim 18 further comprising additional plurality of cross members and additional plurality of lateral members and plurality of connectors and cover material such that a covered structure is thereby configured.

* * * * *